US006168055B1

(12) United States Patent
Grados

(10) Patent No.: US 6,168,055 B1
(45) Date of Patent: Jan. 2, 2001

(54) CASE WITH WRIST STRAP AND REMOVABLE ACCESSORY

(76) Inventor: Christian Grados, 34, rue Jean Maridor, F-75015 Paris (FR)

( * ) Notice: Under 35 U.S.C. 154(b), the term of this patent shall be extended for 0 days.

(21) Appl. No.: 09/194,917

(22) PCT Filed: Jun. 2, 1997

(86) PCT No.: PCT/FR97/00952

§ 371 Date: Dec. 4, 1998

§ 102(e) Date: Dec. 4, 1998

(87) PCT Pub. No.: WO97/46922

PCT Pub. Date: Dec. 11, 1997

(30) Foreign Application Priority Data

Jun. 4, 1996 (FR) ..... 96/06889

(51) Int. Cl.[7] ..... A44C 5/00

(52) U.S. Cl. ..... 224/152; 24/265 WS; 224/164; 224/165; 224/167; 224/170; 224/173; 224/174

(58) Field of Search ..... 224/219, 152, 224/165, 164, 167, 170, 171, 173, 172, 179, 174; 24/265 WS; 63/3, 3.1; 368/282

(56) References Cited

U.S. PATENT DOCUMENTS

| | | | | |
|---|---|---|---|---|
| 3,019,503 | * | 2/1962 | Flacco et al. | 224/173 |
| 4,855,972 | * | 8/1989 | Eiss | 224/173 X |
| 5,102,023 | * | 4/1992 | Nguyen | 224/152 X |
| 5,168,480 | * | 12/1992 | Dodier | 368/282 |
| 5,259,540 | * | 11/1993 | Kocznar et al. | 224/219 |
| 5,398,218 | * | 3/1995 | Munnier et al. | 368/282 |
| 5,416,953 | * | 5/1995 | Hui | 24/265 WS |

FOREIGN PATENT DOCUMENTS 933969 8/1963 (GB) .

* cited by examiner

*Primary Examiner*—Gregory M. Vidovich
*Assistant Examiner*—Maerena W. Brevard
(74) *Attorney, Agent, or Firm*—Notaro & Michalos P.C.

(57) ABSTRACT

Strap 9 and case 1 assembly destined to be worn on the wrist with the strap 9 being fixed in a removable manner at its respective ends 10 linking up with connecting portions of the case 1. At least one of the connecting portions includes a hole 8 designed to receive a fastening part 16 of a decorative item 14, the corresponding end 10 of the strap 9 projecting into the hole 8 to lock the said decorative item 14 in place.

12 Claims, 3 Drawing Sheets

CASE WITH WRIST STRAP AND REMOVABLE ACCESSORY

FIELD OF THE INVENTION

This invention relates to the field of straps and cases, such as watch cases, intended to be worn on the wrist and capable of being combined with an accessory intended to be secured in a removable manner to the case, for example a watch case.

BACKGROUND OF THE INVENTION

Interchangeable watch accessories have been known which are mounted on a watch case by tightening the said case onto its periphery. These accessories generally leave the watch face visible and may contain designs or decorations which are flat or three dimensional, decorative, colorful, etc. However, it has been seen that the mounting of these accessories is not satisfactory in so far as the way in which the accessory is secured to the watch periphery is not sufficiently solid to support an accessory which may be large, and is not reliable enough.

SUMMARY OF THE INVENTION

The aim of this invention is to remedy these problems by obtaining a reliable mounting onto the case.

The aim of this invention is a strap and case assembly destined to be worn on the wrist and a decorative item destined to cover the case at least partially.

The strap and case assembly, according to the invention, is destined to be worn on the wrist with the strap being secured in a removable manner by its respective ends joining with the connecting parts or portions of the case. At least one of the connecting parts or portions contains at least one hole or recess designed to accept a fastening member of a decorative item, with the corresponding end of the strap projecting into the hole to lock the said decorative item. The decorative item is therefore reliably secured onto the case.

In a construction method of the invention, the strap includes a body which has two ends secured to the case, with each end comprising a head which is connected to the body by an intermediate portion with the head being able to link up, in order to secure the strap, with a groove in the connecting portion of the case, the two lips of the groove being in contact with the intermediate portion of the strap. The body of the strap can include, for example, two parts fitted with a length adjusting system of even a single part made from an extendible material. Preferably, the hole or recess is connected to or communicates with the groove so that the head of the strap projects into the hole or recess while locking the decorative item in place inserted into the recess and of a shape in line with that of the recess and the head of the strap.

In a construction method of the invention, the groove of the case is closed on one side of the case and open on the other side of the case with the strap being secured to the case by a transverse movement engaging the head into the open side of the case groove and the intermediate portion between the lips of the groove.

In a construction method the invention, the head of the strap is semi-circular in shape and projects over one edge of the hole or recess. The hole or recess can be cleared (a through-hole) or closed.

The accessory, according to the invention, is destined to cover the case at least partially worn on the wrist, fitted on one side in contact with the case by projecting fastening means. The fastening means have on their lower end at least one projection on at least one side of the lower end and destined to be secured to the case by means of a locking device.

In a construction method of the invention, the accessory comprises two hook-shaped fastening devices, one lateral side of each of which is fitted with a longitudinal slot with the fastening device being able to project into the said slot. The decorative item can then be secured to a watch case.

With the invention, the accessory is discretely, reliably and efficiently mounted onto the case and the results obtained are uniform.

The invention will be better understood upon studying a construction method described as a non limiting example and illustrated by the attached drawings.

DESCRIPTION OF THE PREFERRED EMBODIMENT

Figure 1:
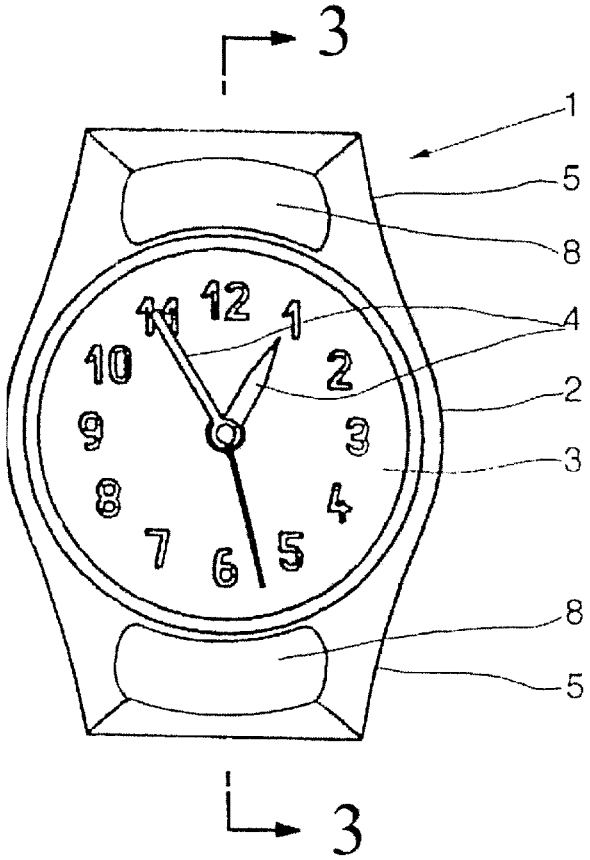
FIG. 1 is a top view of a watch case in accordance with the invention.
Figure 2:
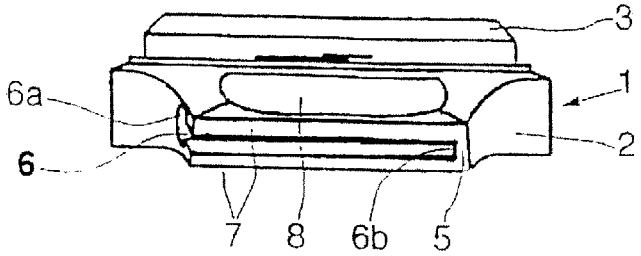
FIG. 2 is a side view of the watch case of FIG. 1.

As can be seen on FIGS. 1 and 2, the watch case 1 consists of a base 2 supporting a circular face 3 and fitted with hands 4. The base 2 comprises two mounting portions 5, one at each end of the face 3. Each mounting portion 5 comprises a groove 6 open at one end 6*a* and closed at the other end 6*b*. The groove comprises two lips 7 which partially close the said groove 6. On the top of each mounting portion 5 is fitted a hole or recess 8 leading to the groove 6. As a variation, several holes can be included in each mounting portion 5 or else at least one hole open laterally one an edge of the mounting portion 5.

Figure 3:
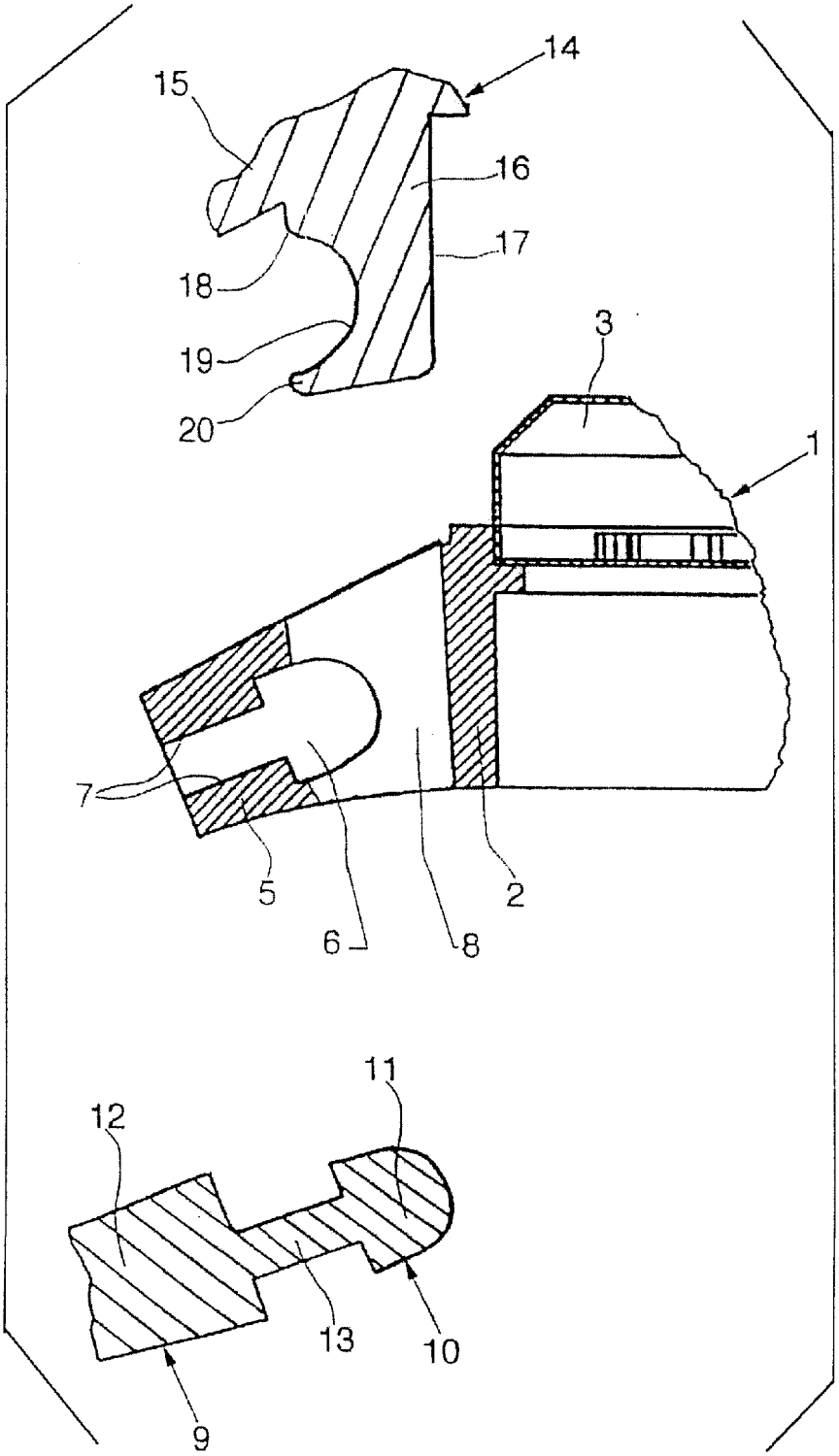
FIG. 3 is a cross section along 3—3 of FIG. 1 showing an exploded view of the assembly of the strap, the watch case and the decorative items.

As can be seen in FIG. 3, the hole 8 is open but, as a variation, a closed hole 8 can be provided as shown in FIG. 6. The strap 9, for example made from an elastomere material, has an end 10 fitted with a semi-circular head 11 which connects to the body 12 of the strap 9 by an intermediate portion 13. The intermediate portion 13 is thinner than the head 11.

Thus, to secure the strap 9 to the case 1, the end 10 of the strap 9 is inserted into the open end 6*a* of the groove 6 and is slidably inserted into the groove 6 until it butts up against the closed end 6*b* of the groove 6.

The head 11 of the end 10 is therefore fitted in the groove 6 and the intermediate portion 13 is arranged between the lips 7 of the mounting portion 5 of the case 1. As the head 11 is larger than the gap separating the lips 7 in which the intermediate portion 13 is housed, the strap 9 is fixed with respect to the case 1.

Figure 4:
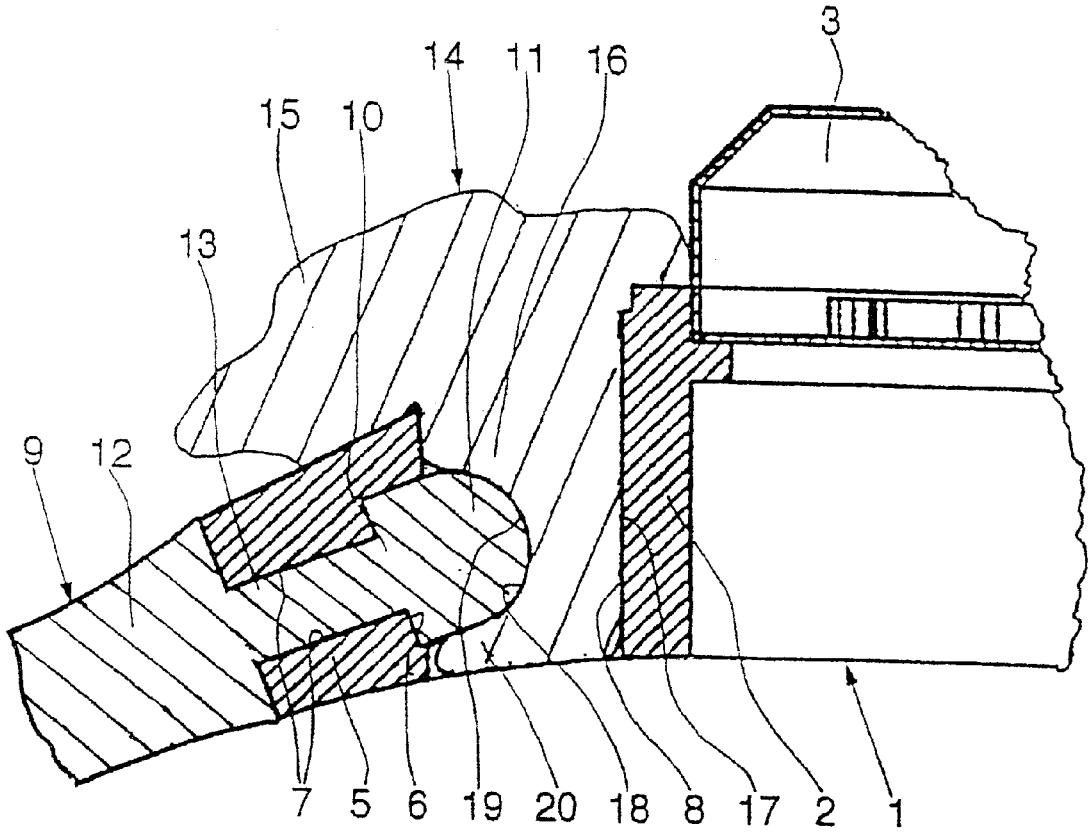
FIG. 4 is a similar view to FIG. 3 showing the aforementioned components after being assembled.

The decorative item 14, of which only a part is represented on FIGS. 3 and 4, comprises a decorative, colorful, or educational item and a lower hook-shaped part or fastening part 16 for securing to the case 1. The fastening part 16 projects downwards with respect to the upper part 15 and is of a shape which is suitable for inserting into the hole 8. The fastening part 16 has an almost rectangular cross section with a flat surface 17 on one side and a hollow surface 18 on the other which includes a longitudinal slot 19 in the shape of an arc of a circle similar to the groove 6 of the case 1.

Thus, before fitting the strap, the decorative item 14 is placed over the case 1. The decorative item 14 is lowered which causes the fastening part 16 to be inserted into the hole 8 and the said fastening part 16 is driven home into the hole 8 until the slot 19 aligns with the groove 6 of the mounting portion 5 of the case 1. The strap 9 can then be fitted into the slot 6 as shown previously by means of a lateral movement.

The assembly as shown in FIG. 4 is therefore obtained. The head 11 of the strap 9 projects into the hole 8 and forms a locking mechanism for the decorative item 14 with respect to the case 1. The lower end 20 of the fastening part 16 of the decorative item 14 forms, with respect to the slot 19, a lateral projection held by the head 11 of the strap 9.

Dismantling is performed in the reverse order to assembly. Firstly the strap 9 is removed by sliding it laterally then the decorative item 14 is removed by lifting it upwards. The decorative item 14 can be secured to all types of watches, fun watches, fake watches, etc. The decorative item in general leaves the face of the case visible but, in construction variations, can cover it permanently or with a hinged cover.

With the invention, a decorative accessory is obtained which can be easily and reliably secured to and can also be easily removed from a case.

What is claimed is:

1. A case assembly comprising:

a case having connecting portions, at least one of said portions having an upper surface and a hole extending downwardly from said upper surface;

an accessory having at least one fastening member having a size and shape to fit within said hole in said at least one connecting portion;

a wrist strap having a pair of opposite end portions respectively connected to said connecting portions of said case one of said end portions extending into said hole and engaging said fastening member to retain said accessory assembled on said case.

2. The assembly of claim 1 wherein said fastening member includes a lateral projection and wherein said at least one of said end portions of said strap overlies said lateral projection.

3. The assembly of claim 1 wherein said at least one connecting portion has a groove opening to said recess and said at least one of said end portions is slidably received in said groove.

4. The assembly of claim 3 wherein said groove has a narrow gap defined by a pair of lips opening to an adjacent end of said connecting portion, said at least one end portion of said strap comprising a head connected to a body of said strap by an intermediate portion, said intermediate portion received within said gap.

5. The assembly of claim 4 wherein said fastening member has a slot that receives said head, and a lateral projection, said at least one end portion overlying said lateral projection and said slot being defined in part by an upper surface of said lateral projection.

6. The assembly of claim 4 wherein said fastening member has a shape complementary to the shape of the hole and the head of the strap.

7. The assembly of claim 4 wherein said groove is closed at one side of said connecting portion and open on the other side of said connecting portion so that said strap can be secured to said case by a transverse movement of strap relative to said case to cause said head to enter said groove and said intermediate portion to be received within said gap.

8. The assembly of claim 1 wherein said at least one end portion of said strap comprises a generally semicircular head that projects into one side of said hole.

9. The assembly of claim 8 wherein said fastening member has a slot in the form of a circular arc that receives said head, said slot being defined in part by an upper surface of a lateral projection of said fastening member.

10. The assembly of claim 1 wherein said hole extends completely through said connection portion.

11. The assembly of claim 1 wherein said hole is closed.

12. An accessory for attachment to a wrist case assembly including a case and a wrist strap connected to the case, said accessory including an upper portion adapted to partly cover the case and a lower portion comprising at least one fastening member depending from said upper portion and shaped to interfit with a hole extending downwardly from an upper surface of said case and a head portion of said strap in said hole, said fastening member having a slot for receiving the head portion of the strap and a lateral projection under the slot for securing said fastening member to said case and to said strap.

* * * * *